US011462813B2

(12) United States Patent
Palmer et al.

(10) Patent No.: US 11,462,813 B2
(45) Date of Patent: Oct. 4, 2022

(54) ANTENNA TOWER PLATFORM ASSEMBLY

(71) Applicant: CommScope Technologies LLC, Hickory, NC (US)

(72) Inventors: Thomas M. Palmer, Wallingford, CT (US); Dino R. Roy, Saginaw, TX (US); Raphael de la Soujeole, Irving, TX (US)

(73) Assignee: CommScope Technologies LLC, Hickory, NC (US)

( * ) Notice: Subject to any disclaimer, the term of this patent is extended or adjusted under 35 U.S.C. 154(b) by 457 days.

(21) Appl. No.: 16/404,872

(22) Filed: May 7, 2019

(65) Prior Publication Data

US 2019/0348742 A1 Nov. 14, 2019

Related U.S. Application Data

(60) Provisional application No. 62/669,996, filed on May 11, 2018.

(51) Int. Cl.
*H01Q 1/12* (2006.01)

(52) U.S. Cl.
CPC ..... *H01Q 1/1242* (2013.01); *H01Q 1/125* (2013.01); *H01Q 1/1228* (2013.01)

(58) Field of Classification Search
CPC .... H01Q 1/1242; H01Q 1/125; H01Q 1/1228; H01Q 1/246
See application file for complete search history.

(56) References Cited

U.S. PATENT DOCUMENTS

| | | | | |
|---|---|---|---|---|
| 5,467,955 | A * | 11/1995 | Beyersmith | H01Q 1/1242 248/219.3 |
| 5,787,673 | A * | 8/1998 | Noble | E04H 12/085 343/890 |
| 6,088,002 | A * | 7/2000 | Johnson | H01Q 19/108 343/799 |
| 9,118,106 | B2 * | 8/2015 | Adams | H01Q 1/125 |
| 10,526,803 | B2 * | 1/2020 | Franceschino | E04G 5/067 |
| 10,630,348 | B1 * | 4/2020 | Haynes | H04B 7/0413 |
| 2002/0053996 | A1 * | 5/2002 | Ianello | H01Q 1/1242 343/890 |

(Continued)

*Primary Examiner* — Raymond R Chai
(74) *Attorney, Agent, or Firm* — Myers Bigel, P.A.

(57) ABSTRACT

An antenna platform includes: a mounting assembly configured to mount to an antenna tower; a plurality of main floor sections, each of the main floor sections connected to the mounting assembly; a plurality of auxiliary floor sections, the auxiliary floor sections arranged in alternating relationship with the plurality of main floor sections to form an endless platform, each auxiliary floor section mounted to two adjacent main floor sections; a plurality of pole supports mounted to each main floor section; a plurality of horizontal antenna poles mounted to the plurality of pole supports, wherein some of the plurality of horizontal antenna poles are main horizontal antenna poles that are positioned radially outwardly of each main floor section, and wherein others of the plurality of horizontal antenna poles are auxiliary horizontal antenna poles that are positioned radially outwardly of each auxiliary floor section; and a plurality of vertical antenna poles mounted to the horizontal antenna poles.

20 Claims, 5 Drawing Sheets

(56) References Cited

U.S. PATENT DOCUMENTS

2004/0032375 A1* 2/2004 Ianello ..... H01Q 1/12
343/890
2011/0279347 A1* 11/2011 Pass ..... E04G 3/243
343/890

* cited by examiner

ANTENNA TOWER PLATFORM ASSEMBLY

RELATED APPLICATION

The present application claims priority from and the benefit of U.S. Provisional Patent Application No. 62/669,996 filed May 11, 2018, the disclosure of which is hereby incorporated herein in its entirety.

FIELD OF THE INVENTION

The present invention relates generally to platforms, and more particularly to mobile communications site platforms.

BACKGROUND

Various types of towers have been constructed for the purpose of supporting one or more antennas, such as those for broadcasting television and radio signals. Some towers are specifically designed for transmitting and receiving cellular telephone signals and other types of radio frequency (RF) signals. Typically, RF towers are tall, self-supporting structures of one of two types: lattice towers and tubular monopole towers.

RF towers are often designed to allow a person to climb to the top and remain there to install and/or repair RE antennas (e.g., cellular antennas) and other equipment connected to the tower. Platforms are typically mounted near the tops of RF towers (e.g., cellular towers) for supporting workers who may be responsible for installing and/or maintaining RF antennas (e.g., cellular antennas). Such platforms are designed to support the weight of a human and may also be used to support a number of the RF antennas.

Exemplary platforms are described in U.S. Patent Publication No. 2011/0279347 to Pass et al., the disclosure of which is hereby incorporated herein in its entirety. The platform described in Pass et al. is a so-called "six-sector" platform. Most antenna arrangements include antennas that face away from the tower in three different directions separated by 120 degrees. Recently, in the interest of increasing antenna density, some six-sector arrangements have been deployed, in which antennas are directed in six different directions at 60 degree intervals. Some such arrangements have suffered from "shadowing" between antennas that are adjacent to each other.

Based on the foregoing, it may be desirable to provide tower and platform configurations that facilitate installation and maintenance of increasing numbers of antennas.

SUMMARY

As a first aspect, embodiments of the invention are directed to an antenna platform comprising: a mounting assembly configured to mount to an antenna tower; a plurality of main floor sections, each of the main floor sections connected to the mounting assembly; a plurality of auxiliary floor sections, the auxiliary floor sections arranged in alternating relationship with the plurality of main floor sections to form an endless platform, each auxiliary floor section mounted to two adjacent main floor sections; a plurality of pole supports mounted to each main floor section; a plurality of horizontal antenna poles mounted to the plurality of pole supports, wherein some of the plurality of horizontal antenna poles are main horizontal antenna poles that are positioned radially outwardly of each main floor section, and wherein others of the plurality of horizontal antenna poles are auxiliary horizontal antenna poles that are positioned radially outwardly of each auxiliary floor section; and a plurality of vertical antenna poles mounted to the horizontal antenna poles.

As a second aspect, embodiments of the invention are directed to an antenna platform comprising: a mounting assembly configured to mount to an antenna tower; three main floor sections, each of the main floor sections connected to the mounting assembly; three auxiliary floor sections, the auxiliary floor sections arranged in alternating relationship with the plurality of main floor sections to form an endless platform, each auxiliary floor section mounted to two adjacent main floor sections; a plurality of pole supports mounted to each main floor section; a plurality of horizontal antenna poles mounted to the plurality of pole supports, wherein some of the plurality of horizontal antenna poles are main horizontal antenna poles that are positioned radially outwardly of each main floor section, and wherein others of the plurality of horizontal antenna poles are auxiliary horizontal antenna poles that are positioned radially outwardly of each auxiliary floor section; and a plurality of vertical antenna poles mounted to the horizontal antenna poles. Two of the plurality of pole supports are mounted adjacent each end of each main floor section. One of the pole supports mounted to each end of each main floor section supports a main horizontal antenna pole, and the other of the pole supports mounted to each end of each main floor section supports an auxiliary horizontal antenna pole.

DETAILED DESCRIPTION

Figure 1:
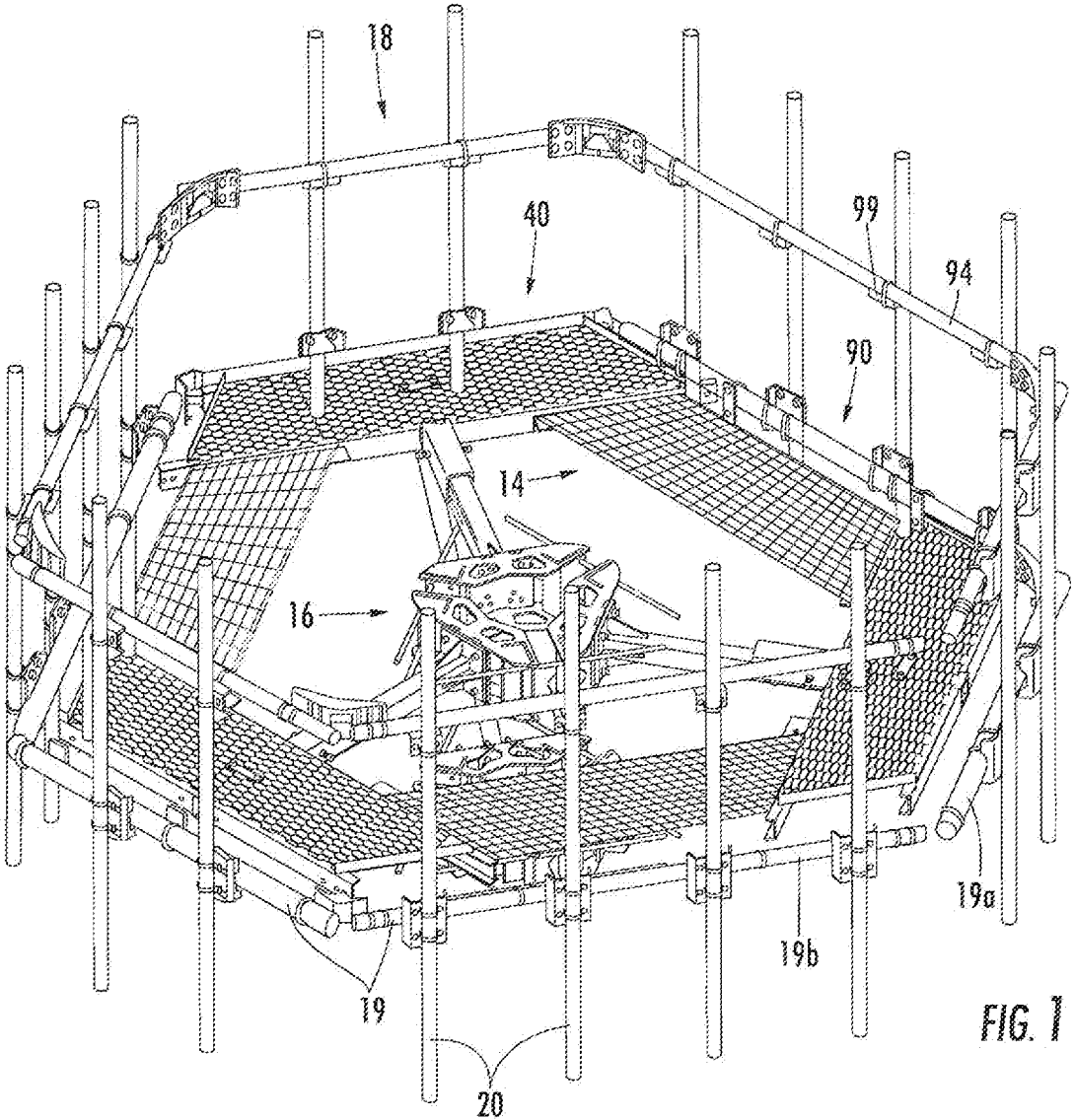
FIG. 1 is a perspective view of an antenna tower platform according to embodiments of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that, when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower". "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Also, as used herein, the terms "horizontal" and "vertical" are intended to encompass structures that may vary from precise horizontal or vertical orientations by a small amount (e.g., 5-10 degrees).

It will also be understood that, as used herein, the terms "example," "exemplary," and derivatives thereof are intended to refer to non-limiting examples and/or variants embodiments discussed herein, and are not intended to indicate preference for one or more embodiments discussed herein compared to one or more other embodiments.

Figure 2:
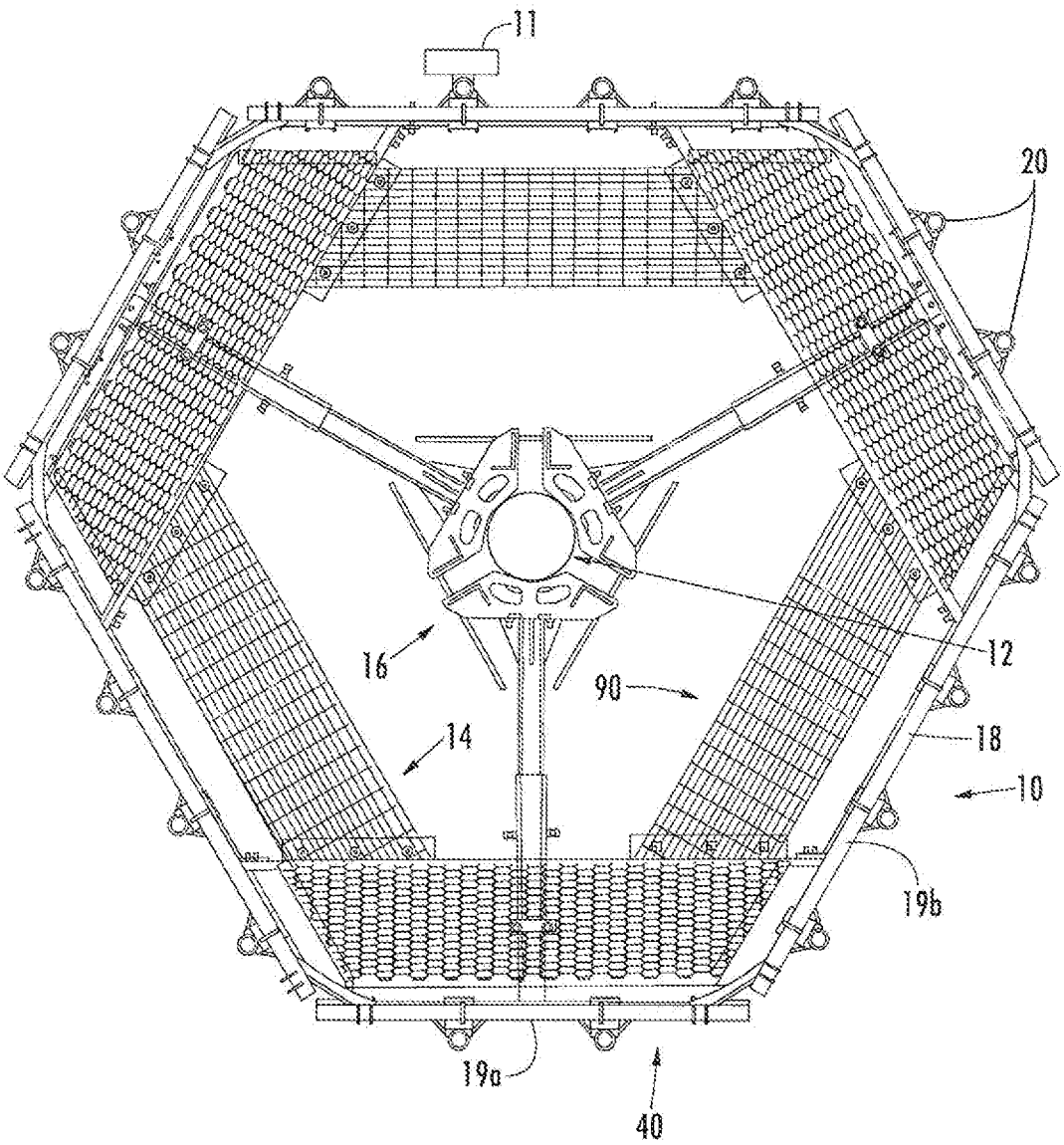
FIG. 2 is a top view of the antenna tower platform of FIG. 1.
Figure 3:
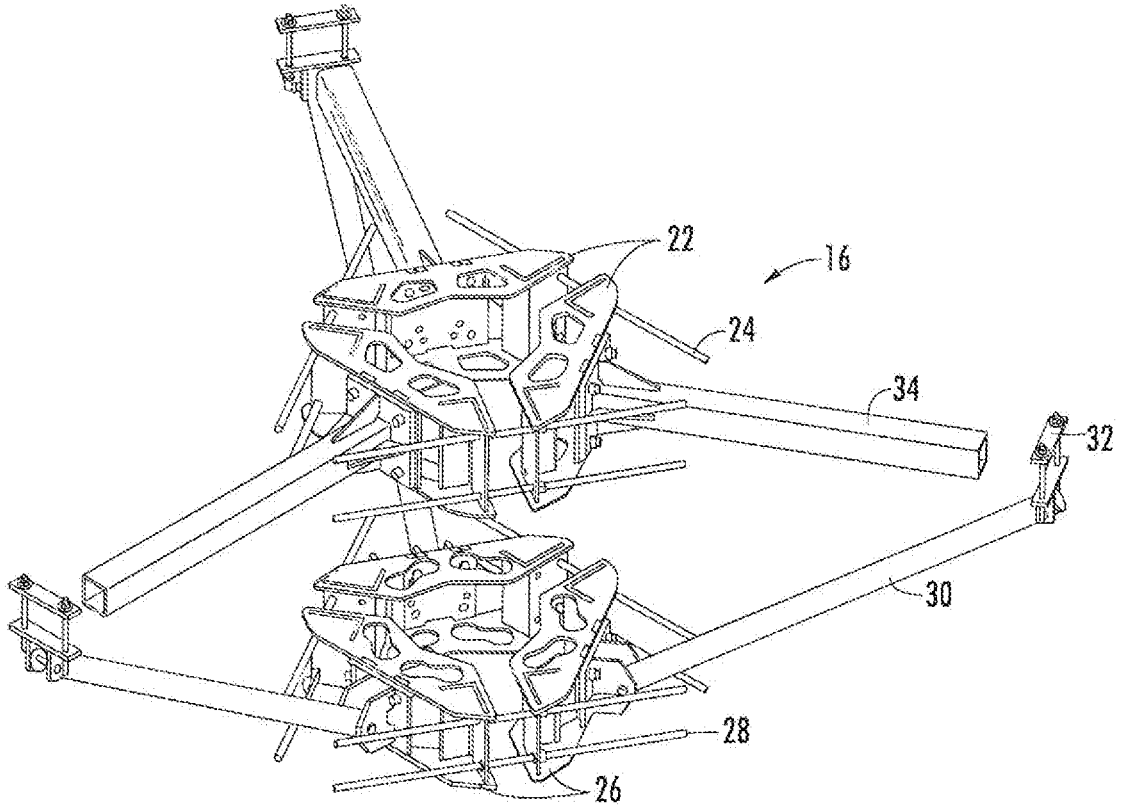
FIG. 3 is a perspective view of the mounting assembly of the antenna tower platform of FIG. 1.

Referring now to the drawings, an antenna tower platform, designated broadly at 10, is shown in FIGS. 1 and 2. The platform 10 is typically mounted to a monopole such as that designated at 12 in FIG. 2. The platform 10 includes a floor 14, a mounting assembly 16, a hand rail 18, horizontal antenna frame poles 19, and vertical antenna poles 20 on which antennas (one of which is shown in FIG. 2 and designated at 11) may be mounted. These components are discussed in greater detail below, Referring now to FIG. 3, the mounting assembly 16 is illustrated therein. The mounting assembly 16 includes three upper brackets 22 and three lower brackets 26. The three upper brackets 22 are joined with threaded rods 24 to form a "circular" upper subassembly; similarly, the three lower brackets 26 are joined with threaded rods 28 to form a "circular" lower subassembly. The upper and lower subassemblies are configured to clamp securely on the monopole 12. A support tube 30 is pivotally attached to each lower bracket 26 and extends radially outward therefrom. A clamp 32 is attached to the end of each support tube 30. A standoff tube 34 is fixed to and extends radially outward from each upper bracket 22.

Figure 4:
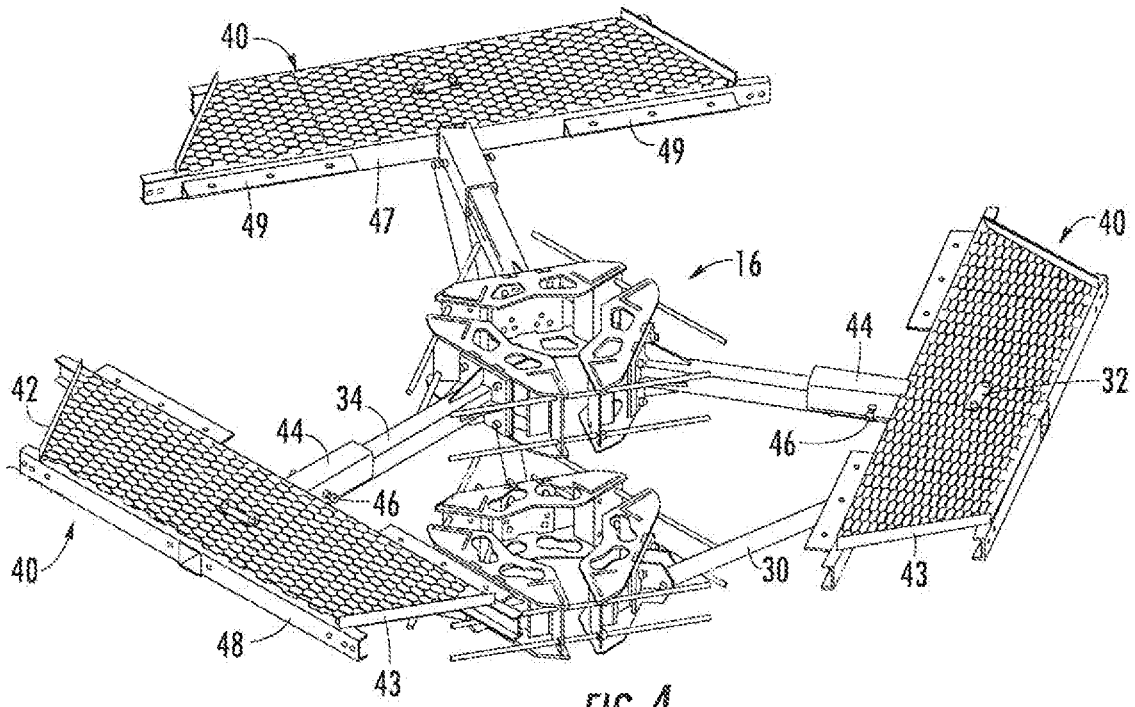
FIG. 4 is a perspective view of the mounting assembly of FIG. 3 with three main floor sections mounted thereto.

The floor 14 includes both three main floor sections 40 and three auxiliary floor sections 90 arranged in alternating fashion to form an endless floor 14. Attachment of the main floor sections 40 to the mounting assembly 16 is illustrated in FIG. 4. Each main floor section 40 includes a grating 42 with downwardly-depending inner and outer rails 47, 48 mounted to opposite sides thereof. Side rails 43 are mounted to the remaining sides of the grating 42. A mounting tube 44 is mounted to the underside of the grating 42. Two angle brackets 49 are mounted to each inner rail 47. Each main; floor section 40 is mounted to a respective standoff tube 34 by inserting the standoff tube 34 into the mounting tube 44. A bolt 46 is employed to secure the standoff tube 34 to the mounting tube 44. The corresponding support tube 30 is pivoted so that the clamp 32 is positioned to secure the support tube 30 to the mounting tube 44 beneath the grating 42 and to the grating 42 itself. The telescoping nature of the standoff tube 34 and mounting tube 44 enables the main floor section 40 to be mounted at different radial positions relative to the monopole 12 (e.g., to enable its use with monopoles of different diameters).

Figure 5:
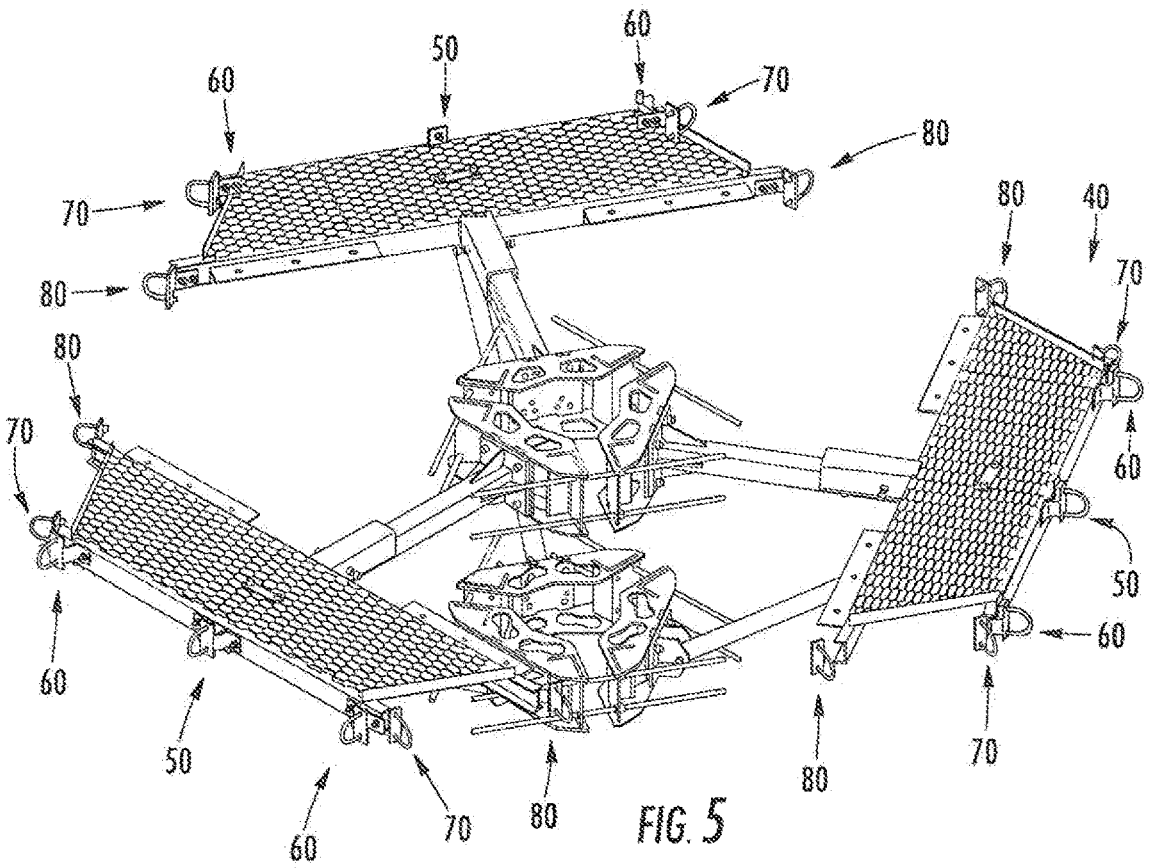
FIG. 5 is a perspective view of the mounting assembly and main floor sections of FIG. 4 with pole supports mounted thereto.

Referring now to FIG. 5, each main floor section 40 includes hardware that assists in the mounting of the horizontal antenna poles 19 mentioned above. More specifically, four different types, of supports are mounted to each main floor section 40; namely, each main floor section 40 has one central pole support 50, two end pole supports 60, two outer corner pole supports 70, and two inner corner pole supports 80. Each of these is described in greater detail below.

Figure 6:
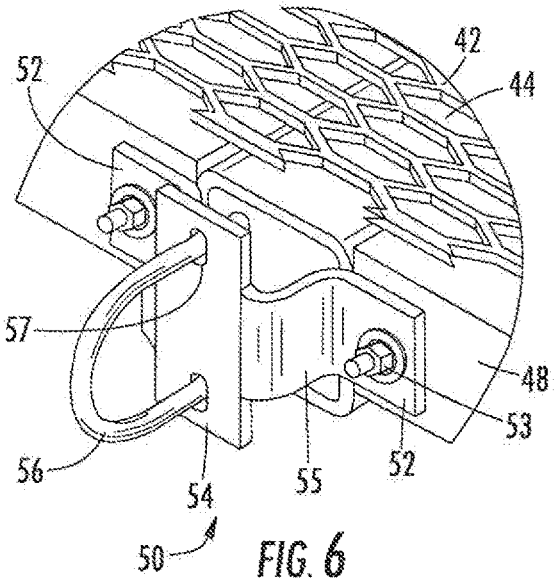
FIG. 6 is an enlarged perspective view of a central pole support mounted to a main floor section of FIG. 5.

As shown in FIG. 6, each central pole support 50 includes two flanges 52 that are mounted to the outer rail 48 via bolts 53. A center panel 54 is spaced radially outwardly from the flanges 52 via two arms 55. In some embodiments, the center panel 54 is spaced between about 1 and 3 inches from the outer rail 48. A U-bolt 56 is vertically mounted to the center panel 54 through holes 57.

Figure 7:
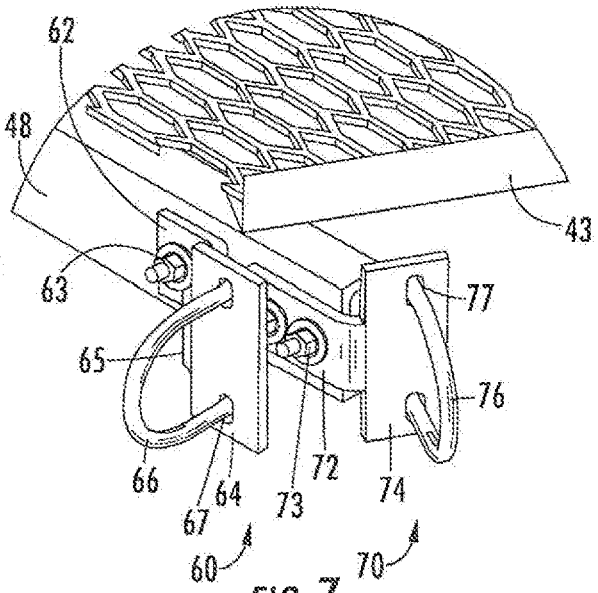
FIG. 7 is an enlarged perspective view of a corner pole support and an outer auxiliary pole support mounted to a main floor section of FIG. 5.

Referring now to FIG. 7, an exemplary end pole support 60 shown therein includes a flange 62 that is mounted to an end portion of the outer rail 48 via bolts 63. A mounting panel 64 is spaced radially-outwardly from the flange 62 via an arm 65. A U-bolt 66 is vertically mounted to the mounting panel 64 through holes 67.

Referring still to FIG. 7, an exemplary outer corner pole support 70 shown therein includes a flange 72 that is mounted to the end of the outer rail 48 via bolts 73. As can be seen in FIG. 7, the flange 72 is located between the outer rail 48 and the mounting panel 64 of the end pole support 60. A mounting panel 74 merges with and extends at approximately a 120 degree from a side end of the flange 72. A U-bolt 76 is mounted vertically to the mounting panel 74 through holes 77.

Figure 8:
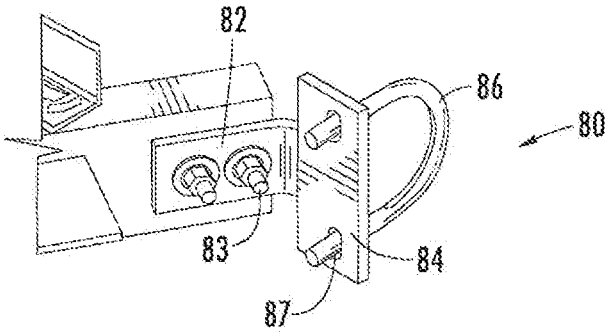
FIG. 8 is an enlarged perspective view of an inner auxiliary pole support mounted to a main floor section of FIG. 5.

Referring now to FIG. 8, an exemplary inner corner pole support 80 shown therein includes a flange 82 that is mounted to the inner rail 47 via bolts 83. A mounting panel 84 merges with and extends at approximately a 120 degree angle from a side edge of the flange 82. A U-bolt 86 is mounted vertically to the mounting panel 84 through holes 87.

Figure 10:
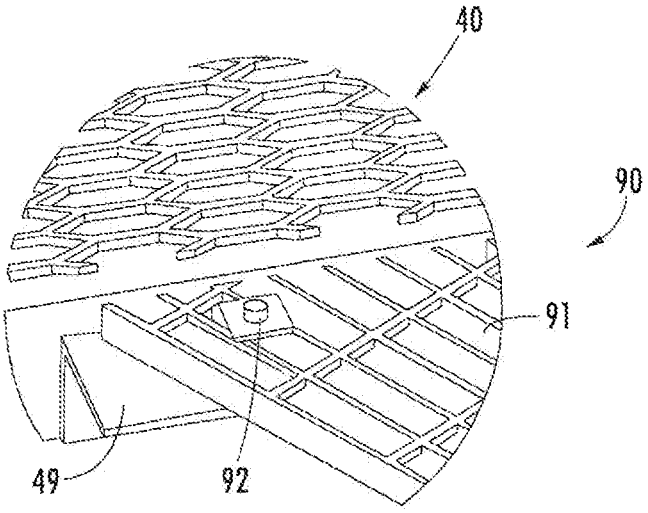
FIG. 10 is an enlarged perspective view of an interface between a main floor section and an auxiliary floor section of the antenna tower platform of FIG. 1.

Referring now to FIGS. 1, 2 and 10, the auxiliary floor sections 90 are illustrated therein. As seen, in FIGS. 1 and 2, the auxiliary floor sections 90 include gratings 91 that are arranged between adjacent main floor sections 40. The side edges of each auxiliary floor section 90 abut the inner rails 47 of the adjacent, main floor sections 40 and overlie the angle brackets 49 mounted thereon. As shown in FIG. 10, the gratings 91 of the auxiliary floor sections 90 are mounted to the angle brackets 49 via bolts 92.

As can be seen in FIG. 1, horizontal antenna frame poles 19 can be mounted radially outward of each of the main and auxiliary floor sections 40, 90. A main horizontal antenna pole 19*a* is mounted to each main floor section 40 with the U-bolts 56 of the central pole support 50 and the U-bolts 66 of the end pole supports 60. Also, an auxiliary horizontal antenna pole 19*b* is mounted radially outward of each auxiliary floor section 90 via the U-bolts 76, 86 of the outer and inner corner pole supports 70, 80 of the main floor sections 40 on either side of that auxiliary floor section 90. As can be seen in FIG. 2, in some embodiments the auxiliary horizontal antenna poles 19*b* are longer than the main horizontal antenna poles 19*a*. The vertical antenna poles 20 can then be mounted to the horizontal antenna poles 19*a*, 19*b* with conventional U-bolt brackets 97.

Figure 9:
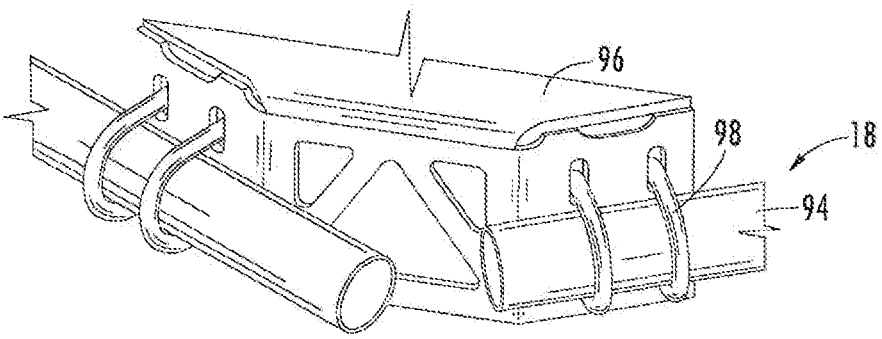
FIG. 9 is an enlarged perspective view of a handrail mounting bracket mounted to two handrail poles of the antenna tower platform of FIG. 1.

Referring now to FIGS. 1, 2 and 9, the handrail 18 comprises six handrail poles 94. The handrail poles 94 are horizontally disposed and are attached at their ends with U-bolts 98 mounted on angled brackets 96. The handrail 18 is then mounted to the upper portions of the vertical antenna poles 20 via U-bolt brackets 99. Antennas can be mounted to the vertical antenna poles 20, as the horizontal antenna poles 19, the handrail poles 94, and the vertical antenna poles 20 form a rigid frame suitable for antenna mounting.

Notably, the antenna platform 10 has the capability for antennas to be mounted on six different sides (i.e., it is a "six-sector" antenna platform as discussed above). Because the horizontal antenna poles 19 are mounted some distance from the main and auxiliary floor sections 40, 90 (in some embodiments, the horizontal poles 19 are mounted between about 1 and 3 inches from the outer edges of the main and auxiliary floor sections 40, 90, the positions of the vertical antenna poles 20 can adjusted horizontally continuously along the length of the horizontal antenna poles 19. This capability provides the installer with flexibility for the mounting of antennas on the vertical antenna poles 20 at any horizontal position.

To provide a sense of scale, the antenna platform 10 is typically between about 12 and 16 feet across, with the main horizontal antenna poles 19*a* being between about 7 and 9 feet in length and the auxiliary horizontal antenna poles 19*b* being between about 5 and 7 feet in length.

Those of skill in this art will appreciate that, in alternative embodiments, the antenna platform 10 may take different configurations. For example, the mounting assembly 16 may feature brackets or other components different from the upper and lower brackets 22, 26 shown herein. The antenna platform 10 may also be mounted to a tower structure other than the monopole 12 shown herein.

Also, although the antenna platform 10 as shown includes three main floor sections 40 and three auxiliary floor sections 90, more or fewer floor sections may be employed; for example, either or both of the main and auxiliary floor sections 40, 90 may be subdivided into multiple parts. In addition, the main and/or auxiliary floor sections 40, 90 may have surfaces other than gratings, such as solid panels, perforated panels, or the like.

Further, more or fewer of each of the central, end, outer corner, and inner corner pole supports 50, 60, 70, 80 may be included. As an example, the central pole support 50 may be omitted in some embodiments. The horizontal and vertical poles 19, 20 may be of different lengths. Other variations will be apparent to those of skill in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An antenna platform, comprising:

a mounting assembly configured to mount to an antenna tower;

a plurality of main floor sections, each of the main floor sections connected to the mounting assembly;

a plurality of auxiliary floor sections, the auxiliary floor sections arranged in alternating relationship with the plurality of main floor sections to form an endless platform, each auxiliary floor section mounted to two adjacent main floor sections;

a plurality of pole supports mounted to each main floor section;

a plurality of horizontal antenna poles mounted to the plurality of pole supports, wherein some of the plurality of horizontal antenna poles are main horizontal antenna poles that are positioned radially outwardly of each main floor section, and wherein others of the plurality of horizontal antenna poles are auxiliary horizontal antenna poles that are positioned radially outwardly of each auxiliary floor section; and a plurality of vertical antenna poles mounted to the horizontal antenna poles.

2. The antenna platform defined in claim 1, further comprising an antenna mounted to each of the vertical antenna poles.

3. The antenna platform defined in claim 1, wherein the plurality of main floor sections is three main floor sections, and the plurality of auxiliary floor sections is three auxiliary floor sections.

4. The antenna platform defined in claim 3, wherein at least two of the plurality of vertical antenna poles are mounted to each of the horizontal antenna poles.

5. The antenna platform defined in claim 1, further comprising a handrail mounted above the main floor sections and the auxiliary floor sections.

6. The antenna platform defined in claim 5, wherein the handrail is mounted to the vertical antenna poles.

7. The antenna platform defined in claim 1, wherein the mounting assembly is configured so that the main floor sections may be mounted at different radial distances from the mounting assembly.

8. The antenna platform defined in claim 1, wherein two of the plurality of pole supports are mounted adjacent each end of each main floor section.

9. The antenna platform defined in claim 8, wherein one of the pole supports mounted to each end of each main floor section supports a main horizontal antenna pole, and the other of the pole supports mounted to each end of each main floor section supports an auxiliary horizontal antenna pole.

10. The antenna platform defined in claim 1, wherein one of the pole supports is mounted adjacent a radially inward edge of each main floor section.

11. The antenna platform defined in claim 10, wherein the pole support mounted adjacent a radially inward edge of each main floor section supports an auxiliary horizontal antenna pole.

12. The antenna platform defined in claim 1, wherein each horizontal antenna pole is spaced from a radially outward edge of an adjacent main floor section or an adjacent auxiliary floor section.

13. The antenna platform defined in claim 1, wherein auxiliary horizontal antenna poles have a greater length than a length of main horizontal antenna poles.

14. An antenna platform, comprising:

a mounting assembly configured to mount to an antenna tower;

three main floor sections, each of the main floor sections connected to the mounting assembly;

three auxiliary floor sections, the auxiliary floor sections arranged in alternating relationship with the plurality of main floor sections to form an endless platform, each auxiliary floor section mounted to two adjacent main floor sections;

a plurality of pole supports mounted to each main floor section;

a plurality of horizontal antenna poles mounted to the plurality of pole supports, wherein some of the plurality of horizontal antenna poles are main horizontal antenna poles that are positioned radially outwardly of each main floor section, and wherein others of the plurality of horizontal antenna poles are auxiliary horizontal antenna poles that are positioned radially outwardly of each auxiliary floor section; and a plurality of vertical antenna poles mounted to the horizontal antenna poles;

wherein two of the plurality of pole supports are mounted adjacent each end of each main floor section; and wherein one of the pole supports mounted to each end of each main floor section supports a main horizontal antenna pole, and the other of the pole supports mounted to each end of each main floor section supports an auxiliary horizontal antenna pole.

15. The antenna platform defined in claim 14, wherein one of the pole supports is mounted adjacent a radially inward edge of each main floor section.

16. The antenna platform defined in claim 15, wherein the pole support mounted adjacent a radially inward edge of each main floor section supports an auxiliary horizontal antenna pole.

17. The antenna platform defined in claim 14, further comprising an antenna mounted to each of the vertical antenna poles.

18. The antenna platform defined in claim 14, further comprising a handrail mounted above the main floor sections and the auxiliary floor sections.

19. The antenna platform defined in claim 18, wherein the handrail is mounted to the vertical antenna poles.

20. The antenna platform defined in claim 14, wherein each horizontal antenna pole is spaced from a radially outward edge of an adjacent main floor section or an adjacent auxiliary floor section.

* * * * *